United States Patent [19]

Labutski, III

[11] 4,413,870

[45] Nov. 8, 1983

[54] PIVOTABLE SPARK PLUG CONNECTOR

[76] Inventor: Justyn J. Labutski, III, 1557 Hearthstone Dr., San Jose, Calif. 95122

[21] Appl. No.: 288,458

[22] Filed: Jul. 30, 1981

[51] Int. Cl.[3] ..... H01R 13/62

[52] U.S. Cl. ..... 339/6 R; 339/26; 339/213 S; 339/245; 403/97

[58] Field of Search ..... 403/97; 339/6 R, 6 A, 339/6 RL, 26, 59 R, 204, 205, 213 R, 213 S, 213 T, 245

[56] References Cited

U.S. PATENT DOCUMENTS

| | | | |
|---|---|---|---|
| 648,361 | 4/1900 | Sheahan | 403/97 |
| 1,228,012 | 5/1917 | Forth | 16/49 |
| 1,649,951 | 11/1927 | English | 403/96 |
| 1,838,051 | 12/1931 | Cadieux | 339/26 |
| 1,989,893 | 2/1935 | Taylor | 339/2 A |
| 2,159,150 | 5/1939 | Heintz | 339/26 |
| 2,171,165 | 8/1939 | Rabezzana | 339/26 |
| 2,276,256 | 3/1942 | Visness et al. | 403/97 |
| 2,361,853 | 10/1944 | Lundquist | 403/97 |
| 2,444,207 | 6/1948 | Smith | 339/6 A |
| 2,447,026 | 8/1948 | O'Brien et al. | 339/6 A |
| 2,602,863 | 7/1952 | Raymond et al. | 403/97 |
| 2,617,671 | 11/1952 | Barrango | 403/58 |
| 2,665,673 | 1/1954 | Woofter | 339/26 |
| 2,792,558 | 5/1957 | Woofter | 339/26 |
| 2,943,139 | 6/1960 | Skunda | 339/26 |
| 3,354,419 | 11/1967 | Miller, Jr. | 339/26 |
| 3,597,723 | 8/1971 | Schmidt et al. | 339/26 |
| 3,922,481 | 11/1975 | Lewis | 403/97 |

FOREIGN PATENT DOCUMENTS

| | | | |
|---|---|---|---|
| 151858 | 12/1937 | Austria . | |
| 2604424 | 8/1977 | Fed. Rep. of Germany | 339/6 R |
| 16828 | of 1911 | United Kingdom . | |
| 516640 | 1/1940 | United Kingdom | 339/6 A |
| 738018 | 6/1980 | U.S.S.R. | 339/6 RL |

*Primary Examiner*—John McQuade
*Assistant Examiner*—Gary F. Paumen
*Attorney, Agent, or Firm*—Hamrick, Hoffman & Guillot

[57] ABSTRACT

A pivotal spark plug connector (10) has a wire clamp part (12) and a spark plug terminal receptacle part (16) pivotably connected together and held in a desired position by a position-retaining mechanism (18) including a pair of substantially planar, circular portions (32, 34) disposed with opposed faces (40, 42) of each in abutting relation such that teeth (36, 38) formed on the opposed faces (40, 42) in the form of radially extending ridges can interengage with one another under the bias of a spring (52) or other resilient element (70, 74). The wire clamp part (12) and terminal receptacle part (16) can be positioned relative to one another under a force which overcomes the bias of the resilient element on the circular portions (32, 34) of the position-retaining mechanism (18). A boot (58) having a bore (62) of two different diameters and external serrations (68) to facilitate flexing is arrangeable over the connector for shielding it from contaminates.

10 Claims, 10 Drawing Figures

PIVOTABLE SPARK PLUG CONNECTOR

BACKGROUND OF THE INVENTION

1. Field of the Invention

This invention relates generally to electrical connectors, and more particularly to a spark plug connector which is adjustable in order to obtain a desired angle between a spark ignition wire and an associated spark plug.

2. Description of the Prior Art

A long recognized problem encountered with internal combustion engines such as used in motor vehicles, and the like, is that the wires which transmit an electrical impulse to a spark plug in a predetermined sequence must lie in a certain relationship with respect to an associated spark plug in order to insure a good electrical connection between the wire and plug. The conventional solution to this problem is to supply the spark plug ignition wire for a particular engine as part of a set of wires of predetermined varying sizes provided with a respective connector of an appropriate angle for a specific plug. This arrangement results in the necessity of a relatively large number of different sets of ignition wires to be kept in stock by auto parts distributors, dealers, and the like.

It has been recognized that the aforementioned problem could be overcome by providing spark plug connectors which permit the ignition wire to be connected to an associated spark plug at a variable angle so as to permit a proper connection between the wire and plug regardless of the position and orientation of the plug. In this manner, a given set of spark plug ignition wires can be used with a large number of engines. An example of a variable angle spark plug connector can be found in U.S. Pat. No. 3,354,419, issued Nov. 21, 1967, to L. E. Miller, Jr., wherein the portion of the connector which receives the associated spark plug is pivotally mounted to a further portion of the connector which is electrically attached to an ignition wire. The two portions are rotatably joined to one another as by a rivet so as to permit their relative movement either between an axial and right angle orientation, or between a 0° and a 180° relationship. A major disadvantage with the various embodiments set forth in this construction, however, is that no structure is provided for retaining the two joined portions in a desired orientation with respect to one another. Thus, the parts may move to a different, less than optimum, relationship after they have been installed on an engine.

Austrian Pat. No. 151,858, issued Dec. 10, 1937 to J. Heitmanek, discloses a pivot joint primarily for use for umbrellas, and the like, which is similar in nature to some of the embodiments of the aforementioned U.S. Pat. No. 3,354,419, but is provided with a detent for indexing the relative position of the two parts of the device and holding the relative moveable parts in a desired position. Spark plug connectors, however, are relatively small in size when compared to an umbrella, and the like, and it is apparent that a conventional detent arrangement as described in U.S. Pat. No. 3,354,419 would be too large for use with such a connector.

U.S. Pat. No. 1,989,893, issued Feb. 5, 1935, to J. Taylor, discloses ignition cable construction in which the spark plug receiving receptacle portion of the connector is pivotally mounted for movement through an arc of approximately 90°, and retained in predetermined positions by a plurality of notches arranged for retaining the receptacle portion of the connector in a desired position. Nevertheless, the construction as set forth in this patent permits only a relative few retaining notches to be provided, thus possibly limiting the applicability of the resulting connector.

U.S. Pat. No. 1,649,951, issued Nov. 22, 1927, to T. A. English, discloses an adjustable connection for brush handles, and the like, in which a pair of disc portions are pivotally joined to one another and one provided with a plurality of projections and the other with a matching number of depressions so as to permit indexing of the disc portions with respect to one another. Once again, as in the Austrian patent discussed above, where the indexing is accomplished by a detent either in the form of a biased ball or a generally hemispherical projection, the number of positions indexable in a comparatively small device such as a spark plug connector is extremely limited. U.S. Pat. No. 2,617,671, issued Nov. 11, 1962, to C. Barrango, on the other hand, discloses a pivot joint for use in manikins, and the like, which employs friction linings and plates to hold articulated portions of the manikin in a desired position. Once again, however, the relatively small size of a spark plug connector, however, particularly in comparison to the forces which can be applied to a connector, make it impractical to employ friction couplings to hold the parts of the connector in a desired orientation with respect to each other.

It is also desirable to provide spark plug connectors, and the like, with a cover or boot, an example of which is set forth in U.S. Pat. No. 2,943,139, issued June 28, 1960, to M. Skunda. Conventionally, these boots are formed in a predetermined internal angle as seen in the aforementioned U.S. patent, with U.S. Pat. No. 2,792,558, issued May 14, 1957, to R. C. Woofter, disclosing a spark plug boot having associated therewith a specially constructed terminal which permits a spark plug connector to be connected to a spark plug at an oblique angle while still disposed within a rigid boot. U.S. Pat. No. 2,665,673, issued Jan. 12, 1954, to R. C. Woofter, discloses a spark plug boot formed with a plurality of circumferential corregations permitting flexing of the boot to conform to the position of an ignition wire associated with the connector. This boot, however, does nothing to retain the wire and connector in a predetermined position relative to an associated spark plug.

Finally, British Pat. No. 16,828, issued June 13, 1912, to Longford, et al, discloses a spark plug receiving receptacle provided with a pin which can be inserted into the terminal end of an associated wire for connection of the receptacle to the wire. This construction, however, creates the additional problem or requiring one installing the set of spark plug wires to place the receptacle portion on the wire.

SUMMARY OF THE PRESENT INVENTION

It is an object of the present invention to provide a spark plug connector adjustable to fit any spark plug on an engine being wired, while retaining the position desired once adjusted.

It is another object of the present invention to provide a spark plug connector which can be adjusted to a relatively large number of positions and retained in such positions by a positive indexing arrangement.

Yet another object of the present invention is to provide a boot for a spark plug connector according to the invention which will conform to the orientation of the connector while still providing suitable protection to the connector and an associated spark plug terminal.

Briefly, these and other objects are achieved according to the present invention by providing a pivotable spark plug connector having a wire clamp part and a spark plug terminal receptacle part pivotally connected to one another and forming a position-retaining mechanism including at least one pair of adjacent disc portions having provided on opposed faces thereof radially extending ridges and cooperating depression for indexing the parts relative to one another. A resilient element, such as a spring, is provided for biasing the disc portions toward one another and holding the projections in the depressions against the forces being exerted against the pivot joint between the two parts so that a predetermined force must be applied in order to move the parts relative to one another. This resilient element may be in the form of a resilient bushing, a generally U-shaped beam spring, a compression spring, and the like.

A boot is provided which is in the form of a sleeve constructed from a resilient material and provided with a through bore larger in diameter in the area which is to fit over the wire clamp part of the connector than the diameter of the portion of the boot which is to fit over the terminal receptacle part of the connector, and provided in the area of the position-retaining mechanism of the connector with a plurality of corregations substantially half way around a circumference of a cylindrical outer surface of the boot.

An advantage of the present invention is that it permits a single set of ignition wires of a predetermined length to be used with a very large number of internal combustion engines, and the like, by permitting the wires to be adjusted to any appropriate spark plug of the engine.

Another advantage of the present invention is that only a single set of wires of a predetermined length can be used to fit the spark plugs of a large number of internal combustion engines, and the like.

Another advantage of the present invention is that the connector according to the invention will tend to stay in proper angular orientation once adjusted, thus increasing the life of the associated ignition wires and assuring proper functioning of an associated engine.

Still another advantage of the present invention is that the connector according to the invention is effectively shielded from the various contaminents to which spark plug connectors are exposed in order to assure good electrical connection between the connector and associated spark plug over a long period of time.

IN THE DRAWING

DESCRIPTION OF THE PREFERRED EMBODIMENT

Figure 1:
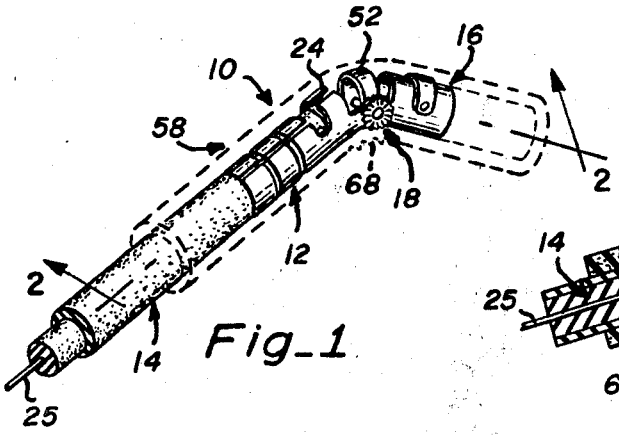
FIG. 1 is a fragmentary, schematic, perspective view, partly in broken lines, showing a spark plug connector assembly according to the present invention.
Figure 2:
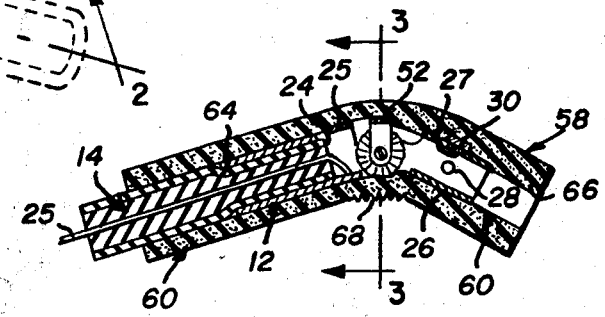
FIG. 2 is a fragmentary, sectional view taken generally along the line 2—2 of FIG. 1.
Figure 3:
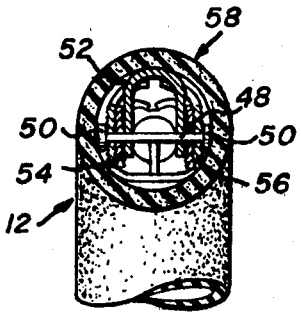
FIG. 3 is a fragmentary, sectional view taken generally along the line 3—3 of FIG. 3.
Figure 4:
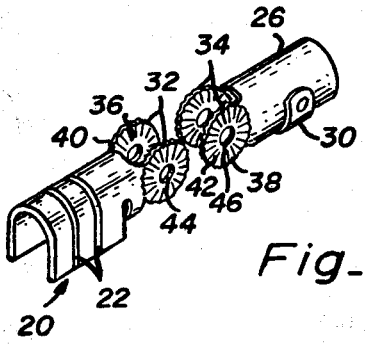
FIG. 4 is an exploded perspective view showing the two principal parts of a spark plug connector according to the present invention.
Figure 5:
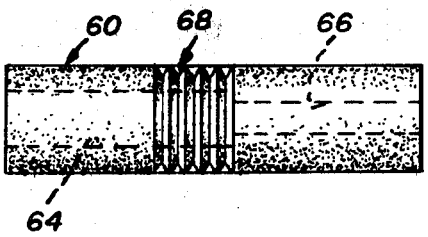
FIG. 5 is a bottom plan view showing a boot for use with a spark plug connector according to the present invention.

Referring now more particularly to FIGS. 1–5 of the drawings, a pivotable spark plug connector assembly 10 according to the present invention includes a wire clamp part 12 for being mounted on a conventional ignition wire such as the illustrated wire 14 and having pivotally connected thereto a spark plug terminal receptacle part 16 for removably receiving a spark plug terminal T in a conventional manner. A position-retaining mechanism 18 is associated with wire clamp part 12 and terminal receptacle part 16 for pivotally connecting one to the other in a position-retaining manner as to be described below.

Wire clamp part 12 comprises a crimp portion 20 initially in the form of a generally U-shaped area the legs of which are crimped down around the associated wire 14 in a conventional manner so as to form a generally barrel-like portion gripping wire 14. A plurality of grooves 22, with three such grooves being illustrated, are disposed circumferentially along the longitudinally extent of crimp portion 20 to facilitate holding wire 14 in place. Wire 14 extends from portion 20 to a collar 24 to which the electrically conductive core 25 of the insulated wire 14 can be electrically contacted as by sitting the surrounding insulation so as to complete an electrical circuit through the electrically conductive parts 12 and 16, both preferably constructed from a suitable metal. Part 16 comprises a split ring 26 which can have the illustrated key-locking arrangement 27 to hold ring 26 together with a certain amount of play. Ring 26 also is provided with a pair of opposed openings 28 arranged for receiving the hemispherical projections forming the ends of legs of a semicircular spring clip 30, which helps bias split ring 216 toward a closed mode, thus facilitating retention of receptacle part 16 on an associated spark plug.

Position-retaining mechanism 18 includes two pairs of cooperating parts in the form of circular portions 32 and 34, with portion 32 being provided as an extension of wire clamp part 12 and portion 34 an extension of receptacle part 16. Each of the portions 32 and 34 is provided with teeth 36 and 38 on respective, opposed faces 40 and 42 so as to be interengageable with one another. More specifically, ridges which will interengage with one another to form a rachet assembly. While the number of teeth may vary, spacing of teeth 36, 38 at 22.5° intervals about an associated circular portion 32, 34 has been found satisfactory to give a sufficient number of possible orientations between parts 12 and 16. The two pairs of circular portions 32, 34, which pairs are mirror images of each other, are disposed in spaced relation, with an arrangement being disposed between the pairs of portions 32, 34 for biasing portions 34, and faces 42 thereof, up against faces 40 of portions 32 in order to maintain teeth 36 and 38 in interengaged relation. As will be appreciated, the amount of the bias exerted on portions 34 will determine the amount of force required to adjust parts 12 and 16 relative to one another.

Holes 44 and 46 are provided centrally of circular portions 32 and 34, respectively, for receiving the shank of a pin 48 having two spaced ends terminating in flanges 50. In practice, it is contemplated that pin 48 will be a headed rivet crimped in place by conventional techniques after being inserted into the holes 44 and 46. Once positioned, pin 48 forms a pivot axis about which parts 12 and 16 move relative to one another.

The biasing referred to above is carried out in the embodiment illustrated in FIGS. 1–5 by a generally U-shaped beam spring 52 disposed between and pivotably mounted relative to the pairs of circular portions 32, 34. More specifically, spring 52 is provided in leg portions thereof with apertures 54 and 56 in which is pivotably disposed pin 48 so as to retain spring 52 in position relative to circular portions 34 and cause spring 52 to bias portions 34 against the associated portions 32.

A boot 58 is provided for removeably covering both the clamp part 12 and receptable part 16 of connector assembly 10. This boot 58 comprises a sleeve 60 constructed from a suitable flexible, electrically insulative material, such as and having a length through which extends a bore 62, a portion 64 of which has a larger diameter than the remaining portions 66. Stated otherwise, portion 64 can be considered a counterbored section of bore 62. By this arrangement, portion 66 of bore 62 will fit snuggly over receptacle part 16 and terminal T of a spark plug in order to prevent contamination of these parts, while portion 64 of bore 62 will allow clamp part 12 and, particularly, positive retaining mechanism 18 sufficient space to permit adjustment of part 12 relative to part 16. A plurality of serrations 68 are formed in the outer surface of sleeve 60 intermediate the length thereof for facilitating flexing of sleeve 60, and hence the pivoting movement of connector assembly 10. More specifically, serrations 68 extend away from the interface between bore portions 64 and 66 and from portion 66 a part of the distance of portion 64. These serrations 68, which extend substantially one half the way around the generally cylindrical sleeve 60, increase the flexibility of sleeve 60 in this area.

Figure 6:
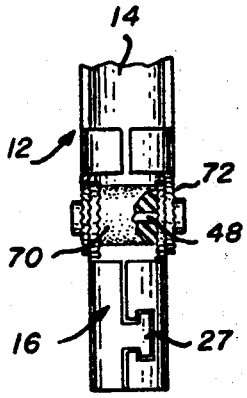
FIG. 6 is a fragmentary, top plan view showing a second embodiment of a spark plug connector according to the present invention.
Figure 7:
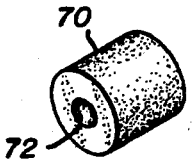
FIG. 7 is a perspective view showing a resilient bushing used with the embodiment of the invention seen in FIG. 6.

Referring now more particularly to FIGS. 6 and 7 of the drawings, a connector according the invention is shown wherein the biasing arrangement is formed by a generally annular bushing 70 constructed from a resilient material, such as a synthetic rubber, and provided with an axial bore 72 which permits bushing 70 to be disposed on pin 28 between the circular portions 34. By suitably dimensioning bushing 70 relative to the spacing between circular portions 34, bushing 70 will be caused to exert a bias on portions 34 so as to force same against the associated portions 32.

Figure 8:
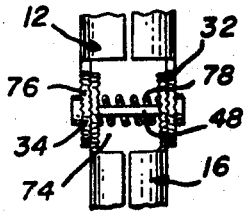
FIG. 8 is a fragmentary, top plan view showing a third embodiment of a spark plug connector according to the present invention.

FIG. 8 illustrates a further embodiment of a connector according to the invention wherein the bias arrangement comprises a coiled compression spring 74 disposed between the circular portions 34 of the connector such that a pair of spaced ends 76 and 78 of spring 74 are seated against portions 34 and are forcing same against the associated portions 32.

Figure 9:
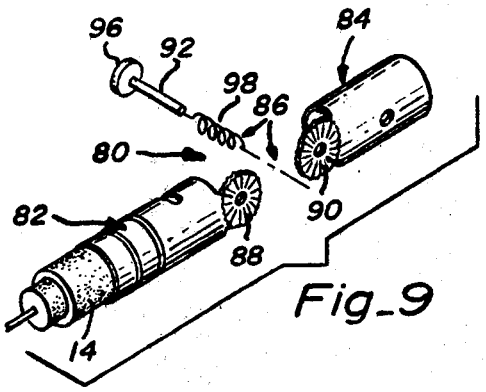
FIG. 9 is a schematic, exploded perspective view showing yet another embodiment of a spark plug connector according to the present invention.
Figure 10:
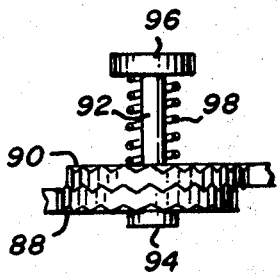
FIG. 10 is a fragmentary, top plan view showing the clutch arrangement used with the embodiment of the invention seen in FIG. 9.

FIGS. 9 and 10 of the drawings illustrate a connector 80 according to the present invention which comprises a wire clamp part 82 and a terminal receptical part 84 similar to clamp part 12 and receptical part 16 except that the position-retaining mechanism 86 includes only one pair of circular portions 88 and 90 similar in construction to portions 32 and 34. A pin 92 provided with a flange 94 similar to the head of pin 48 is disposed in holes provided axially or centrally of portions 88 and 90 in the manner of holes 44 and 46 of portions 32 and 34. This pin 92 is provided with a flange 94 which abuts the outwardly directed face of portion 88 and with a flange 96 of sufficient size to provide a seat for a coiled compression spring 98 the other end of which abuts the inwardly disposed face of circular portion 90. By this arrangement, spring 98 exerts a bias on both portions 88 and 90, through flange 94 and the direct application of force by spring 98 on portion 90, so as to draw the teeth provided on the portions 88 and 90, which teeth are similar to teeth 36 and 38 of portions 32 and 34, into interengagement with one another.

As will be appreciated from the above description and from the drawings, a spark plug connector assembly according to the present invention will permit the proper angle of approach with respect to an associated spark plug to be achieved regardless of the position of the spark plug. In this manner, a single set of spark ignition wires provided with connectors according to the invention can be used for wiring various internal combustion engines.

While the invention has been particularly shown and described with reference to certain preferred embodiments, it will be understood by those skilled in the art that various alterations and modifications in form and detail may be made therein. Accordingly, it is intended that the following claims cover all such alterations and modifications as fall within the true spirit and scope of the invention.

What is claimed is:

1. A pivotable spark plug connector apparatus comprising, in combination:

(a) wire clamp means for being mounted on ignition wire;

(b) a spark plug terminal receptacle means for removably receiving a spark plug terminal; and (c) position-retaining means associated with the wire clamp means and the terminal receptacle means for pivotally connecting one to the other in a position-retaining manner, said position-retaining means including two identical pairs of disc portions, one of the pairs being the mirror image of the other of the pairs, with the pairs being disposed in spaced relation, and bias means arranged between the pairs of cooperating disc portions for exerting a force against each of the pairs.

2. Apparatus as defined in claim 1, further including boot means for removeably covering the clamp means and receptacle means, the boot means comprising a sleeve constructed from a length of flexible material, the sleeve being provided with a bore extending the length thereof, said bore being separated into two portions of different diameters, the one of the portions having a larger diameter being arrangeable over the position-retaining means and wire clamp means, the sleeve having an outer surface with a plurality of serrations being formed therein intermediate the length thereof and along a portion thereof beginning at the interface between the portions of the bore and extending away from the bore having a smaller diameter for facilitating pivoting of the connector apparatus.

3. Apparatus as defined in claim 1, wherein one of the disc portions of each said pairs of disc portions is provided on the wire clamp means and the other of the portions of each said pair is provided on the receptacle means, the disc portions of each said pair being arranged for contacting one another, said bias means engaging the disc portions for forcing same into contact with one another.

4. Apparatus as defined in claim 3, wherein the bias means includes a pin having two spaced ends terminating in flanges, and a resilient element disposed on the pin between the flanges thereof, with each said pair of disc portions being arranged between one of the flanges and the resilient element, the latter biasing said pairs against said flanges.

5. Apparatus as defined in claim 3, wherein each of the disc portions comprises a substantially planar, generally circular portion of a respective one of the clamp means and receptacle means, each of the circular portions being provided with a pair of faces with radially extending teeth provided on opposing faces thereof, the teeth of each said pair of disc portions interengaging to form a ratchet assembly.

6. Apparatus as defined in claim 5, wherein each of the circular portions has a circumference, and the teeth are spaced at 22.5° intervals about the circumference of an associated circular portion.

7. Apparatus as defined in claim 1 wherein the bias means comprises a coiled compression spring disposed between the pairs of disc portions.

8. Apparatus as defined in claim 1, wherein the bias means comprises a generally U-shaped beam spring disposed between and pivotably mounyted on the pair of disc portions.

9. Apparatus as defined in claim 1, wherein the bias means includes a pin having two spaced ends terminating in flanges, and a resilient element disposed on the pin between the flanges thereof, with the pairs of disc parts being arranged between a respective one of the flanges and the resilient element, the latter biasing the disc portions against the associated one of the flanges.

10. Apparatus as defined in claim 2, wherein the resilient element of the bias means comprises a generally cylindrical bushing constructed from a resilient material and disposed on the pin between the pairs of disc portions for exerting a force against each of the pairs of the disc portions.

* * * * *